US005379024A

United States Patent [19]

Hsu

[11] Patent Number: 5,379,024

[45] Date of Patent: Jan. 3, 1995

[54] PICKPOCKET PROTECTIVE WALLET

[76] Inventor: Simon Hsu, 10 Fl., No. 413, Lin San N. Rd., Taipei, Taiwan, Prov. of China

[21] Appl. No.: 130,999

[22] Filed: Oct. 1, 1993

[51] Int. Cl.[6] ..... G08B 13/14

[52] U.S. Cl. ..... 340/571; 200/61.42; 200/61.58 R; 340/568

[58] Field of Search ..... 340/571, 568; 200/61.42, 61.58 R, 61.59, DIG. 2

[56] References Cited

U.S. PATENT DOCUMENTS 3,930,249 12/1975 Steck et al. ..... 340/571

4,884,062 11/1989 Lin et al. ..... 340/571

5,053,750 10/1991 Alex ..... 340/568

*Primary Examiner*—Glen Swann

*Attorney, Agent, or Firm*—Bacon & Thomas

[57] ABSTRACT

A pickpocket protective wallet includes a wallet body and a DC-power-supply-operated alarm device fastened within the wallet body. A normally closed control switch turns on a sound generating circuit, causing it to produce an audio alarm signal. The control switch is opened as the wallet is put in a pocket, causing the sound generating circuit to stop working. The control switch is closed as the wallet is being taken out of the pocket, causing the sound generating circuit to turn on.

5 Claims, 4 Drawing Sheets

PICKPOCKET PROTECTIVE WALLET

BACKGROUND OF THE INVENTION

The present invention relates to wallets, and more particularly relates to a pickpocket protective wallet which produces an audio alarm signal as it is being taken out of the pocket by a pickpocket.

A variety of wallets are known, and widely used for carrying bank-notes, papers, cash, etc. Because people tend to carry a personal wallet in the pocket, the personal wallet may be easily stolen by a pickpocket, particularly when one is passing through or standing in a crowded area.

The present invention has been accomplished to provide an alarm device for a wallet which automatically produces an audio alarm signal as the wallet is being taken out of the pocket by a pickpocket.

SUMMARY OF THE INVENTION

The alarm device is fastened to the wallet by a clip or Velcro tape, and controlled by a control switch to connect a battery power supply to a sound generating circuit thereby, causing the sound generating circuit to produce an audio alarm signal through a buzzer. The control circuit consists of a contact connected to the battery power supply, and a switch lever connected to the sound generating circuit. The switch lever extends out of the wallet and is disconnected from the contact as the wallet is received in a pocket, and therefore the sound generating circuit deactivated. As the wallet is being taken out of the pocket by a pickpocket, the switch lever is released from pressure and returned to its former position in contact with the contact, and therefore the sound generating circuit is activated to produce an audio alarm signal.

DETAILED DESCRIPTION OF THE PREFERRED EMBODIMENTS

Figure 1:
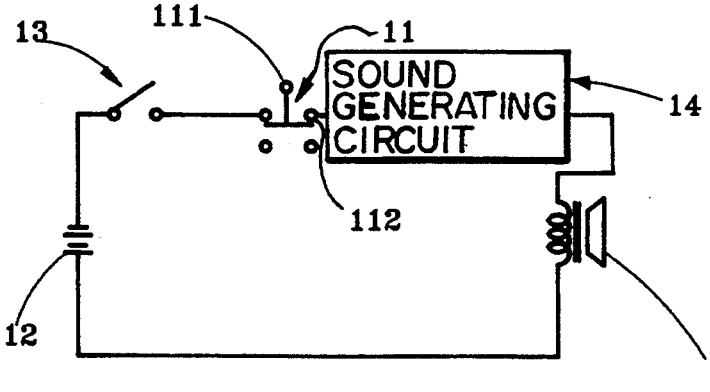
FIG. 1 is a circuit diagram of an alarm circuit according to the present invention.

Referring to FIG. 1, an alarm circuit for an alarm device according to the present invention is generally comprised of a battery unit 12, a power switch 13, a control switch 11, a sound generating circuit 14, and a buzzer 15. The control switch 11 is normally closed, and consists of a contact 112 and a switch lever 111. The operation of the alarm circuit is outlined hereinafter. The power switch 13 is closed to electrically connect the battery unit 12 to the sound generating circuit 14 via the control switch 11, causing it to produce an audio alarm signal through the buzzer 15. As the switch lever 111 is pressed to disengage from the contact 112, the alarm circuit is immediately cut off, and therefore the sound generating circuit is stopped from sending the audio alarm signal through the buzzer 15. By switching off the power switch 13, the alarm circuit is opened, and therefore the alarm device is deactivated.

Figure 2:
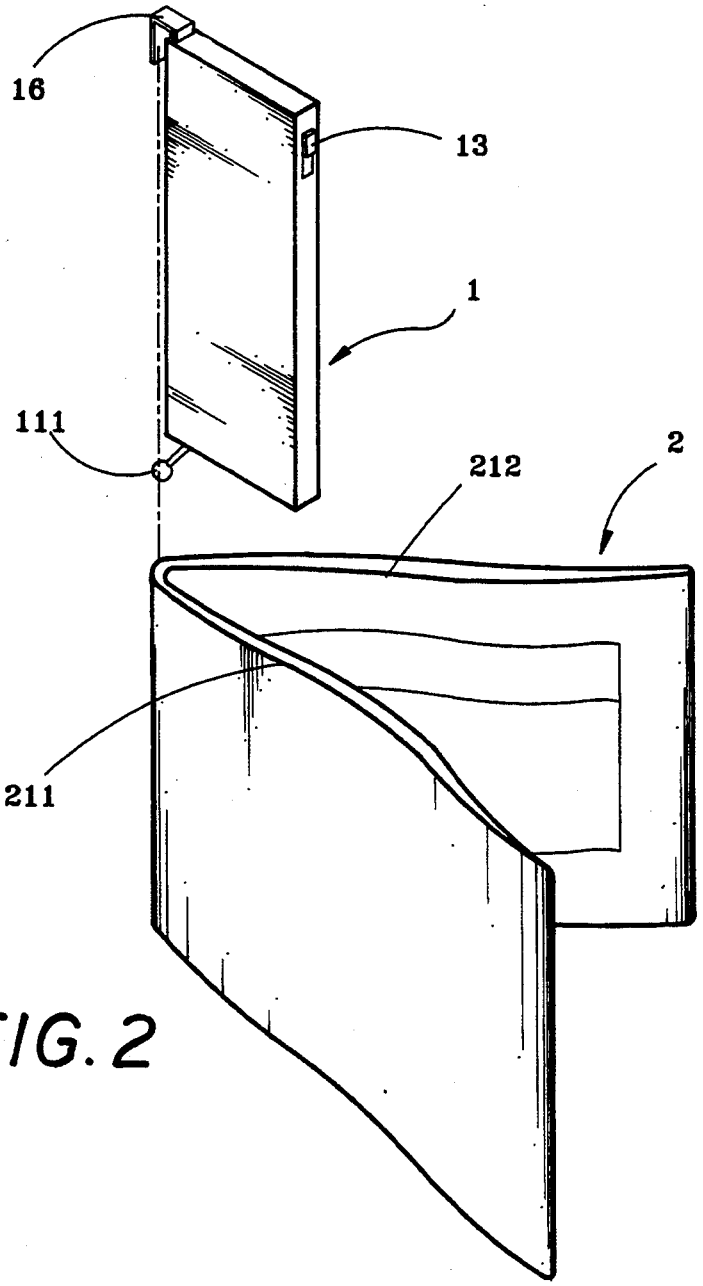
FIG. 2 illustrates the installation of an alarm device in a wallet according to the present invention.

Referring to FIG. 2, the aforesaid alarm device is fastened within a casing 1 and installed in a wallet 2 between two opposite cover panels 211;212 thereof. The casing 1 comprises a a clip 16 fastened to either cover panel 211 or 212 of the wallet 2. When installed, the switch lever 111 extends out of the wallet 2.

Figure 3A:
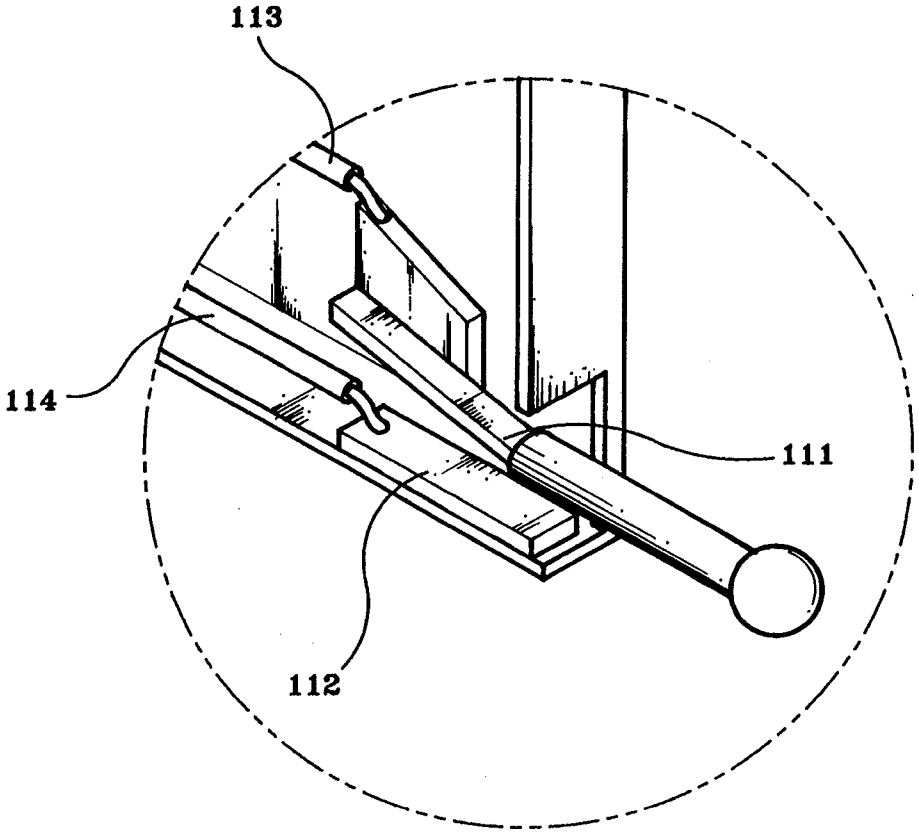
FIG. 3*a* is an enlarged view of the control switch shown in the circled portion of FIG. 3.
Figure 3:
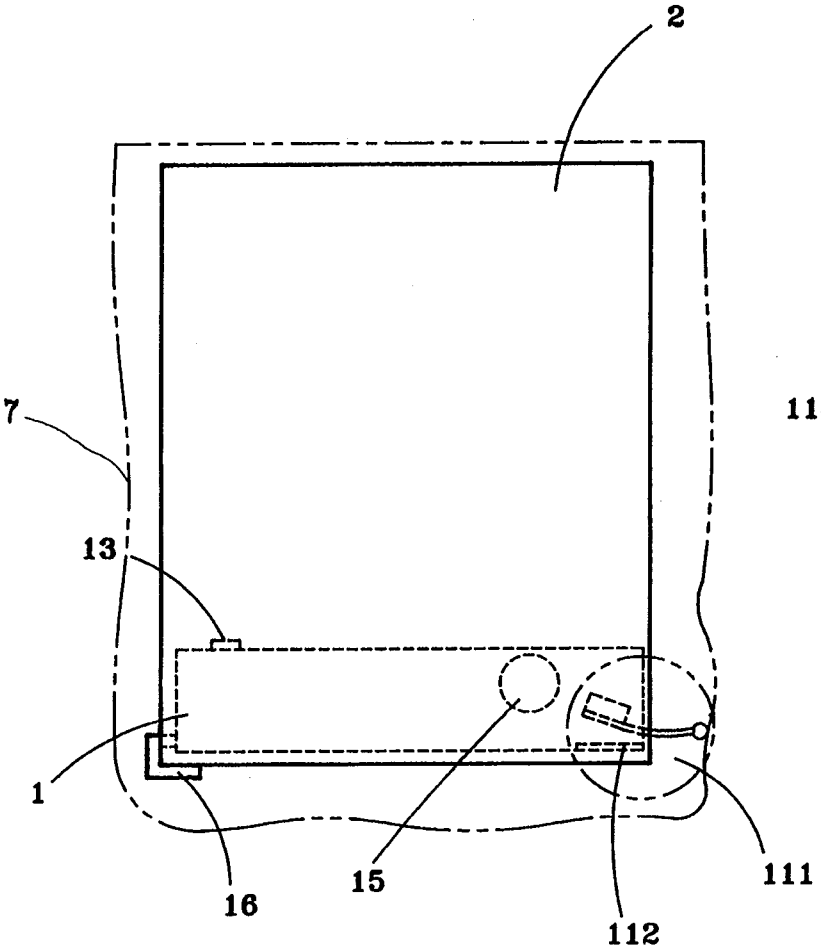
FIG. 3 shows the control switch of the alarm circuit of the alarm device of FIG. 2 in a closed position.
Figure 4A:
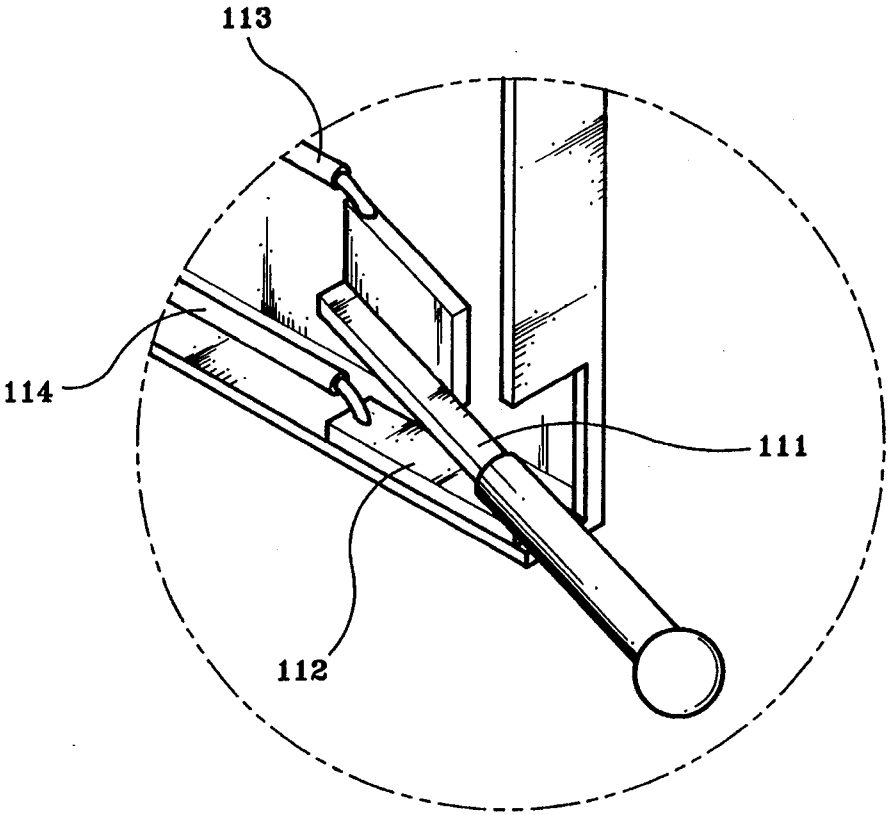
FIG. 4*a* is an enlarged view of the control switch shown in the circled portion of FIG. 4.
Figure 4:
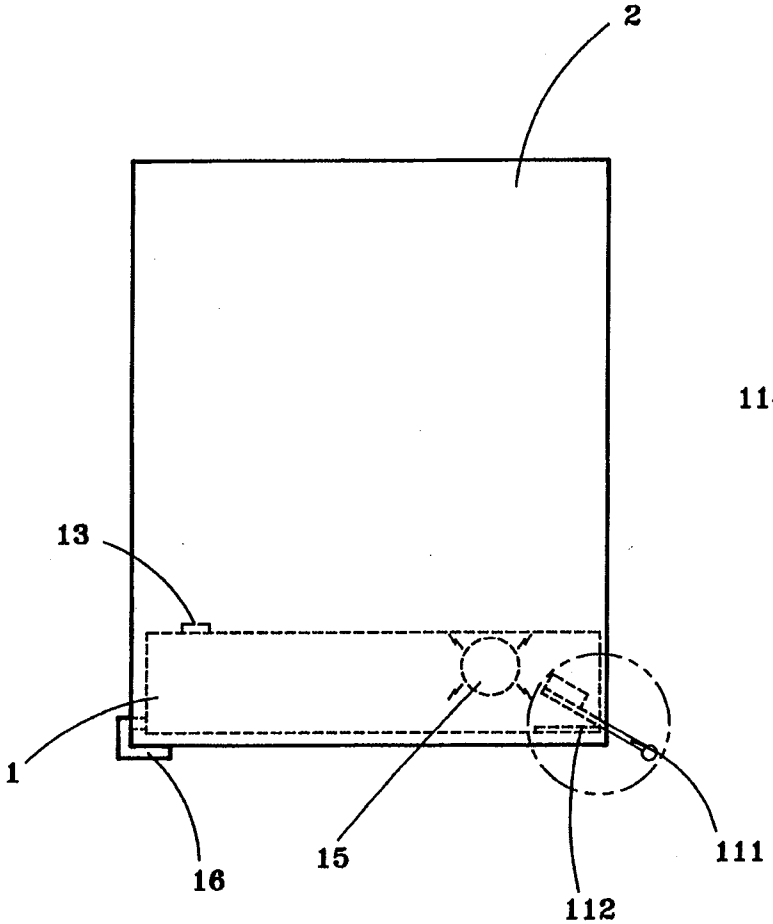
FIG. 4 shows the control switch of the alarm circuit of the alarm device of FIG. 2 in an open position.

Referring to FIGS. 3 and 4, the switch lever 111 and the contact 112 of the control switch 11 are respectively connected to the alarm circuit of the alarm device by conductors 113 and 114, respectively. When the wallet 2 is carried in a pocket 7 with the power switch 13 switched on, the switch lever 111 is forced by the pocket 7 to disengage from the contact 112, and therefore the buzzer 15 is deactivated (see FIG. 3). As the wallet 2 is being taken out of the pocket 7 by a pickpocket, the switch lever 111 is released from pressure and immediately returned to its former position in engagement with the contact 112, causing the sound generating circuit 14 to produce an audio alarm signal through the buzzer 15 (see FIG. 4).

Figure 5:
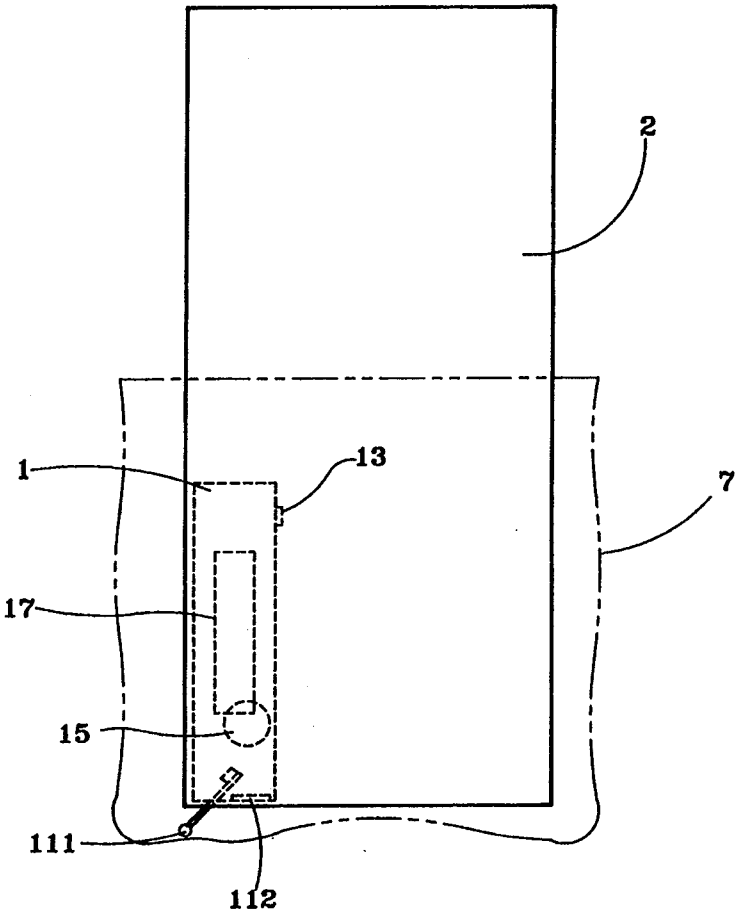
FIG. 5 shows an alternate form of the pickpocket protective wallet of the present invention.
Figure 6:
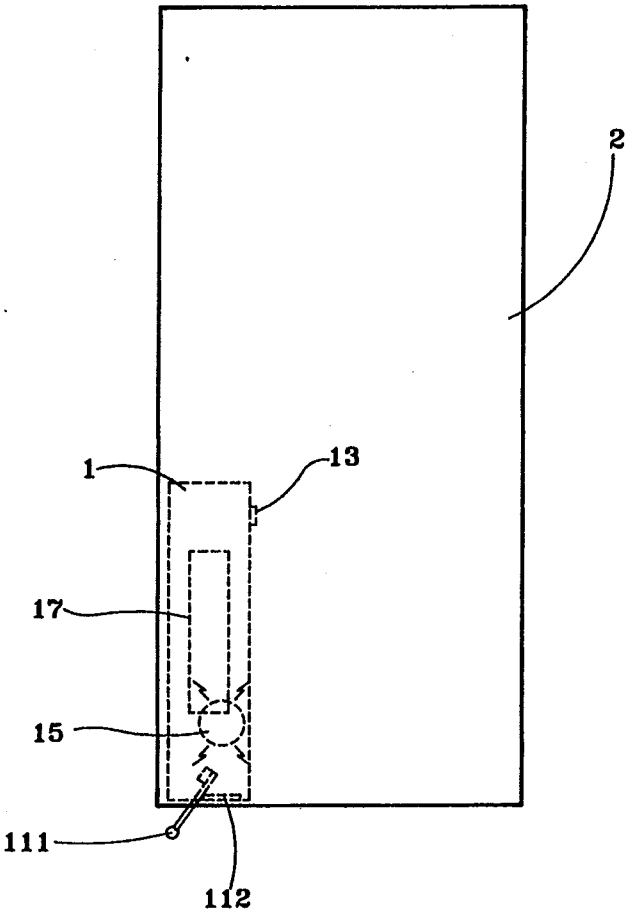
FIG. 6 shows the alarm device of the pickpocket protective wallet of FIG. 5 triggered to activate the alarm.

Referring to FIGS. 5 and 6, therein illustrated is an alternative form of the present invention, in which the alarm device is fastened to the wallet 2 by a hook and loop fastener tape, such as Velcro tape.

As indicated, the present invention provides a pickpocket protective wallet which automatically produces an audio alarm signal as it is being taken out of the pocket by a pickpocket. It the wallet falls out of the pocket due to a careless action of the owner, the alarm device of the wallet will also produces an audio alarm signal to inform the owner.

I claim:

1. A pickpocket protective wallet comprising a wallet and an alarm device fastened to said wallet, said alarm device comprising an alarm circuit controlled by a control switch to electrically connect a battery power supply unit to a sound generating circuit, causing said sound generating circuit to produce an audio alarm signal through a buzzer, wherein said control switch consists of a contact and a switch lever extending out of said wallet and normally disposed in contact with said contact, said switch lever being moved away from said contact to cut off said battery power supply from said sound generating circuit as the wallet is put in a pocket, and said switch lever being returned to its former position in contact with said contact to turn on said sound generating circuit as said wallet is removed from said pocket.

2. The pickpocket protective wallet of claim 1 wherein said alarm device is fastened to said wallet by a clip.

3. The pickpocket protective wallet of claim 1 wherein said alarm device is fastened to said wallet by a tape of hook and loop material.

4. The pickpocket protective wallet of claim 1 wherein said alarm circuit comprises a power switch controlled to connect said battery power supply unit to said control switch.

5. The pickpocket protective wallet of claim 1 wherein said switch lever has one end extending out of said wallet and terminating in a spherical knob.

* * * * *